US005188299A

United States Patent [19]

Hendrickson et al.

[11] Patent Number: 5,188,299

[45] Date of Patent: Feb. 23, 1993

[54] APPARATUS AND METHOD FOR RECYCLING ASPHALT MATERIALS

[75] Inventors: Arthur N. Hendrickson, Coram, N.Y.; Lawrence C. Hanlon, South Portland, Me.; Russell W. Anderson, Mahwah, N.J.

[73] Assignee: Rap Process Machinery Corp., Ramsey, N.J.

[21] Appl. No.: 772,488

[22] Filed: Oct. 7, 1991

[51] Int. Cl.[5] ..... B02C 13/02

[52] U.S. Cl. ..... 241/23; 241/67; 241/167

[58] Field of Search ..... 241/23, 57, 167, 65, 241/74, 67

[56] References Cited

U.S. PATENT DOCUMENTS

| | | | |
|---|---|---|---|
| 527,636 | 10/1894 | Walker | 241/65 |
| 770,823 | 9/1904 | Salzmann | 241/65 |
| 3,871,291 | 3/1975 | Lassiter | 100/93 P |
| 3,975,002 | 8/1976 | Mendenhall | 259/148 |
| 4,106,110 | 8/1978 | Mendenhall | 366/2 |
| 4,369,926 | 1/1983 | Rasmussen et al. | 241/18 |
| 4,373,675 | 2/1983 | Kaufmann | 241/23 |
| 4,555,182 | 11/1985 | Mendenhall | 366/25 |
| 4,932,863 | 6/1990 | Anderson | 432/115 |

FOREIGN PATENT DOCUMENTS

| | | | |
|---|---|---|---|
| 0698649 | 11/1979 | U.S.S.R. | 241/74 |

*Primary Examiner*—Mark Rosenbaum
*Assistant Examiner*—John M. Husar
*Attorney, Agent, or Firm*—Samuelson & Jacob

[57] ABSTRACT

Apparatus and method for processing asphalt material to be recycled by introducing used asphalt material from the field in relatively large pieces, as received from the field, into one end of a cage-like array of tubular breaker members while simultaneously heating the tubular breaker members from the other end of the cage-like array and rotating the cage-like array about a tilted central axis of rotation to tumble the material within the cage-like array and reduce the size of the pieces of material to a desired aggregate size within a mass of material moving toward the other end of the cage-like array, the tubular breaker members being spaced apart circumferentially such that only the desired aggregate-sized pieces in the mass of material pass radially out of the cage-like array for delivery and reuse.

16 Claims, 2 Drawing Sheets

APPARATUS AND METHOD FOR RECYCLING ASPHALT MATERIALS

The present invention relates generally to the processing of asphalt materials and pertains, more specifically, to recycling existing asphalt pavement materials.

Asphalt has long been the material of choice for pavement and has found widespread use throughout the world in filling the need for more and more pavement. More recently, recycled asphalt products are being specified for use in an effort to conserve materials used in asphalt production. The use of recycled asphalt materials has become more important as existing pavement is reconditioned or replaced and the disposal of the old, replaced pavement material becomes more difficult and more costly. As a result, large amounts of old asphalt material have become available for reuse; however, current practices have limited such reuse to crushing the relatively large pieces of old asphalt materials, as received from the field, and then mixing the crushed, reduced-size recyclable asphalt material with new material. The mixing of recyclable asphalt material with virgin asphalt has led to unstable reactions, produces unwanted amounts of pollutants, and thus severely limits the use of recyclable asphalt materials.

Five basic methods currently are in use for the utilization of recyclable asphalt. In the weigh-hopper method, uncoated virgin aggregate is superheated and then added to recyclable asphalt material in a hopper where heat is transferred quite rapidly from the heated aggregate to the recyclable asphalt material. The result is a tendency toward an unstable reaction at the point of blending, limiting the amount of recyclable asphalt material which can be introduced. In the batch plant bucket elevator method, recyclable asphalt material is metered into a bucket elevator where heat transfer takes place. Again, the percentage of recyclable asphalt material must be limited in order to preclude the emission of excessive pollutants. Another method uses a parallel-flow drum mixer in which virgin aggregates are introduced at the burner end of a drum and are superheated. Recyclable asphalt material is introduced downstream, adjacent the center of the drum, where the recyclable asphalt material is mixed with the superheated virgin aggregate and hot gases. The exposure of fine recyclable asphalt material to the superheated aggregate and hot gases causes a rapid flash-off and the emission of "blue-smoke", a highly undesirable pollutant, in addition to other hydrocarbon emissions. These emissions must be controlled, resulting in strict limitations on the amounts of recyclable asphalt products introduced by the method. In a similar procedure, a separate mixing chamber is used in connection with a parallel-flow drum mixer so that the recyclable asphalt materials are mixed with heated aggregate outside the hot gas stream in the drum. The method enables the introduction of greater amounts of recyclable asphalt materials without the creation of blue-smoke, but hydrocarbon emissions must still be contended with. The use of a counter-flow drum mixer with a separate mixing chamber, wherein the location of the burner is reversed so that virgin material moves toward the burner while exhaust gases move in the opposite direction, constitutes another improvement in that even more recyclable asphalt material can be mixed with virgin material; however, the amount of recyclable asphalt material must still be limited in order to control the emission of pollutants. All of the above-outlined methods usually require a separate crusher and screening apparatus for sizing the recyclable asphalt material prior to introducing the material into the mix with virgin aggregate.

The present invention provides apparatus and method which avoids many of the problems encountered in the above-outlined apparatus and methods and exhibits several objects and advantages, some of which may be summarized as follows: Eliminates the need for preliminary crushing and screening of recyclable asphalt materials received from the field, and the equipment needed for such preliminary crushing and screening; precludes direct contact between the recyclable asphalt materials and any open flame or hot gases, thereby eliminating a potential source of pollutants, and especially "blue-smoke" and hydrocarbon emissions; effectively recycles used asphalt materials for use either in a mix containing a very high percentage of recycled product with virgin aggregate and asphalt, or one-hundred percent recycled materials; provides apparatus which is relatively compact and portable for ready transportation and use directly at a project site; enables increased versatility in complementing existing asphalt plants for the use of recycled asphalt product; provides an environmentally sound approach to the conservation of asphalt products at minimal cost; eliminates the need for disposal of used asphalt materials; enables the practical processing of recyclable asphalt materials for widespread use with efficiency and reliability.

The above objects and advantages, as well as further objects and advantages, are attained by the present invention which may be described briefly as apparatus and method for processing recyclable asphalt material received from the field in relatively large pieces for delivery in a mass containing desired smaller aggregate-sized pieces for reuse, the apparatus and method comprising: means for and the step of introducing the relatively large pieces of recyclable asphalt material directly into a cage-like array of breaker members spaced apart from one another circumferentially, the circumferential spacing between adjacent breaker members being selected such that only the desired aggregate-sized pieces of recyclable asphalt material will pass between adjacent breaker members; and means for and the step of heating the breaker members while rotating the cage-like array and moving the recyclable asphalt material axially along the breaker members such that the desired aggregate-sized pieces of recyclable asphalt material are delivered through the circumferential spacing between the breaker members.

The invention will be understood more fully, while still further objects and advantages will become apparent, in the following detailed description of preferred embodiments of the invention illustrated in the accompanying drawing, in which.

Figure 1:
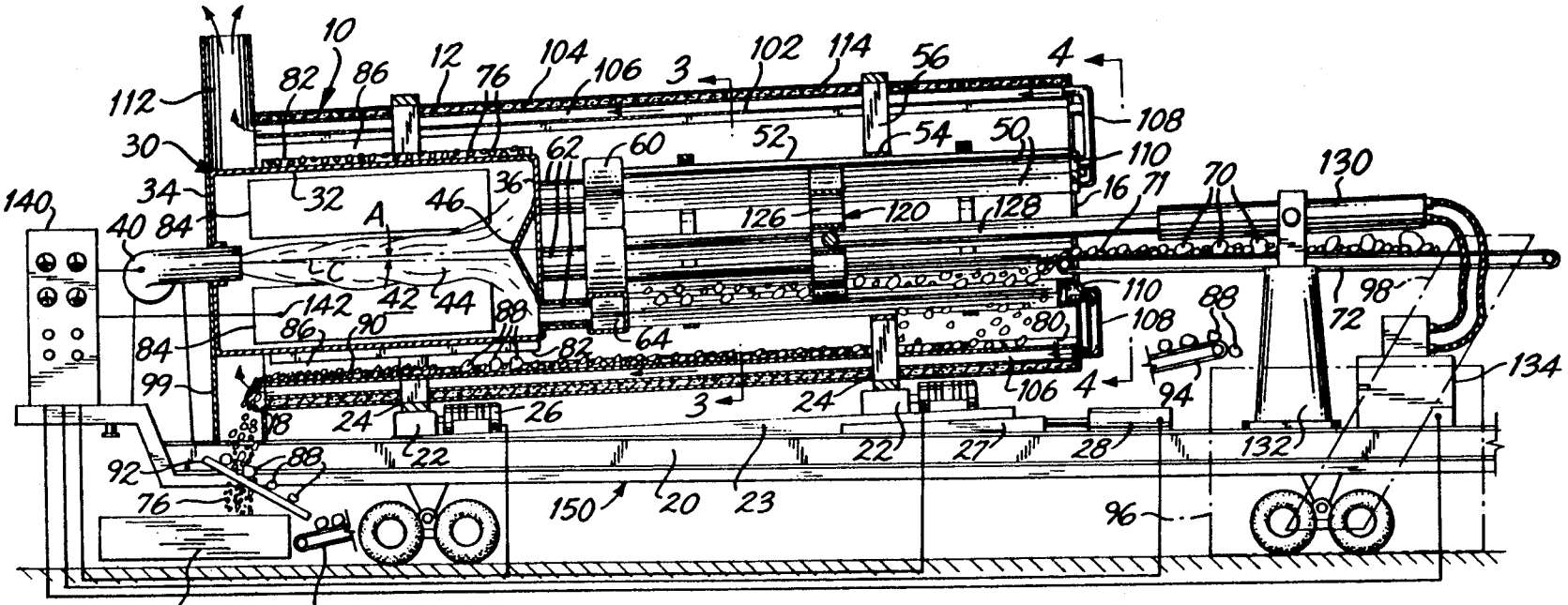
FIG. 1 is a somewhat diagrammatic, longitudinal cross-sectional view of an apparatus constructed in accordance with the present invention, illustrating the method of the invention.
Figure 2:
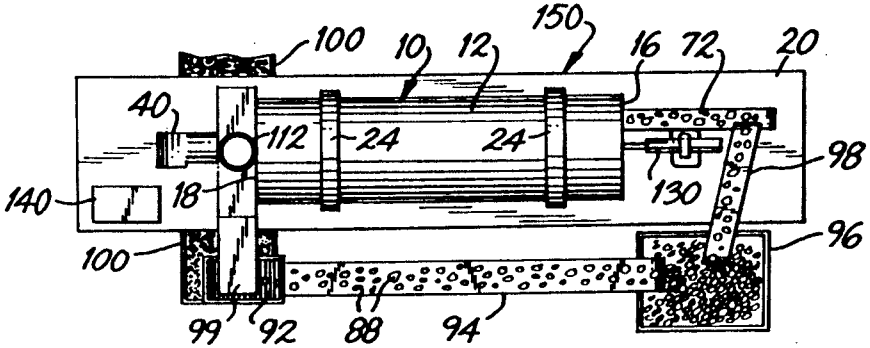
FIG. 2 is a plan view, reduced in size, of the apparatus of FIG. 1.

Referring now to the drawing, and especially to FIGS. 1 and 2 thereof, an apparatus constructed in accordance with the present invention is illustrated generally at 10 and is seen to include an elongate drum 12 having a generally cylindrical wall 14 extending axially between an inlet end 16 and an outlet end 18. Drum 12 is mounted upon a platform 20 for rotation about a central axis C by means of roller assemblies 22 placed on a base 23 on the platform 20 and engaging corresponding circumferential tracks 24 carried by the drum 12, and motors 26 drive the roller assemblies 22, all in a manner now well known in asphalt processing apparatus. Alternately, a separate chain-and-sprocket drive may couple the motors 26 with the drum 12. The base 23 is inclined so that the inlet end 16 of the drum 12 is elevated relative to the outlet end 18. The angle of inclination A is maintained relatively shallow, an angle A of only about four degrees being sufficient for the purposes to be described below. Angle A is selectively adjusted by adjustment means shown in the form of a wedge 27 moved forward or backward by an actuator 28 to increase or decrease the magnitude of angle A.

Figure 3:
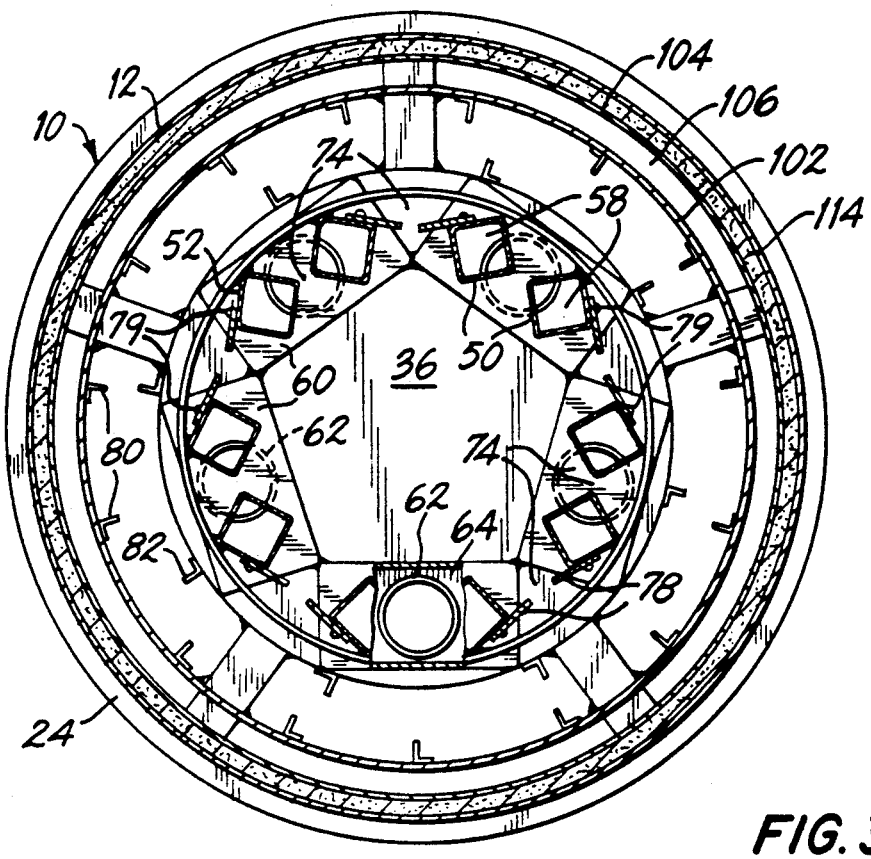
FIG. 3 is an enlarged cross-sectional view taken along line 3—3 of FIG. 1.
Figure 4:
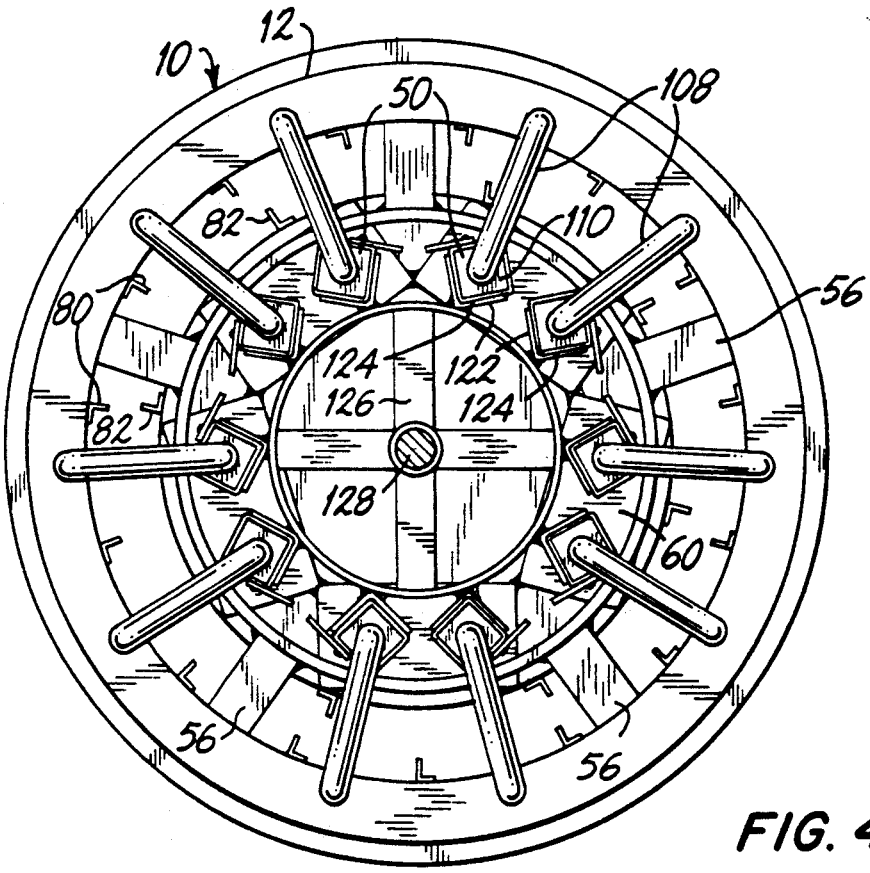
FIG. 4 is an enlarged cross-sectional view taken along line 4—4 of FIG. 1.

A heating chamber 30 is located adjacent the outlet end 18 of the drum 12 and includes a cylindrical side wall 32 which extends along the drum 12 toward the inlet end 16 over a first axial portion of drum 12 from a rear wall 34 to a front wall 36. A burner 40 is mounted on the platform 20 outside the heating chamber 30 and projects into the interior 42 of the heating chamber 30 through the rear wall 34 to provide a heating flame 44 within the interior 42 of the heating chamber 30. Heating flame 44 impinges upon a baffle 46 at the front wall 36. A plurality of breaker members in the form of tubular members 50 extend axially, along a second axial portion of drum 12, between the heating chamber 30 and the inlet end 16 of the drum 12, generally parallel to the central axis C, and are arrayed circumferentially about the central axis C. The tubular members 50 are assembled into a cage-like assembly 52 which is supported within the drum 12 by a support ring 54 and struts 56. As illustrated in FIGS. 3 and 4, each tubular member 50 has an interior 58 which extends axially along the length of the tubular member 50. Headers in the form of manifolds 60 are integral with the ends of the tubular members 50 adjacent the heating chamber 30, and the manifolds 60 are integral with the front wall 36 of the heating chamber 30 to connect the tubular members 50 with the heating chamber 30. As best seen in FIG. 3, as well as in FIG. 1, two tubular members 50 are connected to each manifold 60 and each manifold 60 has a single leg 62 connected to the front wall 36 of the heating chamber 30. The interior 58 of each tubular member 50 communicates with the interior 42 of the heating chamber 30 through the interior 64 of each corresponding manifold 60 so that hot gases generated in the heating chamber 30 pass through the manifolds 60 and into the tubular members 50.

Recyclable asphalt material is received from the field in relatively large pieces 70, usually in chunks spanning about one foot across, and is fed directly into apparatus 10, as seen at 71. The large pieces 70 are fed by an infeed conveyor 72 through the inlet end 16 of the drum 12 and into the cage-like assembly 52 established by the array of tubular members 50. As the drum 12 is rotated, the cage-like assembly 52 also rotates about the central axis C and the large pieces 70 are tumbled within the cage-like assembly 52 and simultaneously are broken up and heated by contact with the tubular members 50 of the cage-like assembly 52 as the recyclable asphalt material proceeds downstream from the inlet end 16 toward the outlet end 18 of the drum 12. The circumferential spacing 74 between adjacent tubular members 50 is selected so that upon reaching the desired aggregate-size, the recyclable asphalt material 76 will drop out of the cage-like assembly 52, and fall to wall 14 of the drum 12. A preferred circumferential spacing 74 is a gap of about two to four inches between adjacent tubular members 50, which circumferential spacing yields a desired size of about three-quarters of an inch in the recycled asphalt material which leaves the drum 12 at the outlet end 18. Auxiliary bars 78 are affixed to some of the tubular members 50 and extend circumferentially to assure that the prescribed spacing 74 is maintained between all adjacent tubular members 50. The spacing 74 between adjacent auxiliary bars 78 is adjustable by means of selectively loosened fasteners 79 which secure the auxiliary bars 78 to the tubular members 50. The desired aggregate-sized recyclable asphalt material 76 continues down the wall 14 of the drum 12, assisted by flights 80 affixed to the wall 14, until the material 76 reaches the outlet end 18 of the drum 12. In addition, material 76 is tumbled onto the side wall 32 of the heating chamber 30 where additional heat is transferred to the material 76 and further flights 82 affixed to side wall 32 assist in moving the material 76 downstream. The side wall 32 of the heating chamber 30 is provided with access panels 84 which enable selective access to the interior portion 86 of the drum 12 around the heating chamber 30 from the interior 42 of the heating chamber 30, so that in the event of a sudden shut-down due to a power failure or the like and a consequent cessation of rotation of the drum 12, the mass of material 76 in the interior portion 86 can be removed while still essentially molten.

The legs 62 of the manifolds 60 are spaced apart circumferentially a distance greater than the spacing 74 between the tubular members 50. Thus, intermediate-sized pieces 88 of recyclable asphalt material which now are smaller than pieces 70, but still remain larger than that which is permitted to fall through spacing 74, will fall between the legs 62 to enter the mass of material in the stream 90 of asphalt material leaving the drum 12. After leaving the drum 12, the stream 90 is passed through a screen 92 where the intermediate-sized pieces 88 are separated and transferred to a back feed conveyor 94. Back feed conveyor 94 delivers the intermediate-sized pieces 88 to a bin 96, and an elevator 98 moves the intermediate-sized pieces 88 from the bin 96 to the infeed conveyor 72 for return to the drum 12. The stream 90 of desired aggregate-sized pieces of material 76 is delivered through an exit chute 99 to an outfeed conveyor 100 for use. It is noted that at no time is the recyclable asphalt material exposed to direct flame. Moreover, introduction of the recyclable asphalt material at the inlet end 16, remote from the heating chamber 30, presents the recyclable asphalt material at the lower temperature end of the drum 12, and the temperature is raised gradually as the material progresses toward the outlet end 18, thereby reducing any tendency toward generating excessive harmful pollutants.

In the preferred configuration, wall 14 of drum 12 is comprised of an inner wall 102 and an outer wall 104, with an annular heat chamber 106 between the inner wall 102 and the outer wall 104. Return members in the form of elbows 108 are connected between the end 110 of each tubular member 50 and the annular heat chamber 106 so that the heated gases which pass from the heating chamber 30 through the tubular members 50 is directed into the annular heat chamber 106 to flow through the wall 14 of the drum 12 and further heat the wall 14 as the heated gases are passed to an exhaust port 112 at the downstream, outlet end 18 of the drum 12. In this manner heat is conserved and more heat is made available for the process. An insulating jacket 114 extends circumferentially around the drum 12 to further conserve heat, as explained in U.S. Pat. No. 4,932,863.

In order to preclude the deleterious build up of excessive asphalt on the tubular members 50, a scraper assembly 120 is mounted for reciprocating movement along the cage-like assembly 52. Referring to FIG. 4, as well as to FIG. 1, scrapers 122 are engaged with the outer surfaces 124 of the tubular members 50 and are affixed to a spider 126 which is carried by a spindle 128. Spindle 128 is reciprocated in upstream and downstream directions periodically by selective actuation of a hydraulic cylinder 130 mounted on a pedestal 132 on platform 20 and actuated under the control of control box 134. Upon actuation of the hydraulic cylinder 130, scrapers 132 will ride upon and move along the outer surfaces 124 of the tubular members 50 to scrape away excessive asphalt and maintain the surfaces 124 free to transfer heat to the pieces 70 of recyclable asphalt being tumbled in the cage-like assembly 52. Tubular members 50 preferably are provided with a rectangular cross-sectional configuration, as shown in FIGS. 3 and 4.

A central control console 140 controls various parameters in the operation of the apparatus 10. Thus, the control console 140 is operated to control the speed of rotation of the motors 26 to select the speed of rotation of drum 12. A temperature sensor 142 in the heating chamber 30 is connected to the control console 140 which, in turn, controls the burner 40 to maintain the temperature within the interior 42 of the heating chamber 30 at a selected level. Further, the selected pitch of the drum 12 is controlled by the control console 140 through operation of the actuator 28. In addition, the control console 140 controls the operation of the scraper assembly 120. Typically, angle A is set at about three to six degrees, the temperature in the interior of the heating chamber 30 is within the range of about fifteen-hundred to two-thousand degrees F., and the speed of rotation of the drum 12 is within the range of about five to seven revolutions per minute. The temperature of the recycled asphalt material exiting at the outlet end 18 of the drum 12 is about two-hundred to two-hundred-fifty degrees F.

Platform 20 is a part of a truck trailer 150 so that the apparatus 10 is portable and is made available readily at a work site. The apparatus 10 is compact and requires very little by way of facilities in order to operate in the field.

It will be seen that the present invention attains the objects and advantages summarized above, namely: Eliminates the need for preliminary crushing and screening of recyclable asphalt materials received from the field, and the equipment needed for such preliminary crushing and screening; precludes direct contact between the recyclable asphalt materials and any open flame or hot gases, thereby eliminating a potential source of pollutants, and especially "blue-smoke" and hydrocarbon emissions; effectively recycles used asphalt materials for use either in a mix containing a very high percentage of recycled product with virgin aggregate and asphalt, or one-hundred percent recycled materials; provides apparatus which is relatively compact and portable for ready transportation and use directly at a project site; enables increased versatility in complementing existing asphalt plants for the use of recycled asphalt product; provides an environmentally sound approach to the conservation of asphalt products at minimal cost; eliminates the need for disposal of used asphalt materials; enables the practical processing of recyclable asphalt materials for widespread use with efficiency and reliability.

It is to be understood that the above detailed description of preferred embodiments of the invention are provided by way of example only. Various details of design, construction and procedure may be modified without departing from the true spirit and scope of the invention as set forth in the appended claims.

The embodiments of the invention in which an exclusive property or privilege is claimed are defined as follows:

1. The method for processing recyclable asphalt material received from the field in relatively large pieces for delivery in a mass containing desired smaller aggregate-sized pieces for reuse, the method comprising:

introducing the relatively large pieces of recyclable asphalt material directly into a cage-like array of breaker members, the breaker members having an axial length and being tubular, with each breaker member having an interior extending along the axial length of the breaker member, the breaker members being spaced apart from one another circumferentially, the circumferential spacing between adjacent breaker members being selected such that only the desired aggregate-sized pieces of recyclable asphalt material will pass between adjacent breaker members; and heating the breaker members through the interior of each breaker member while rotating the cage-like array and moving the recyclable asphalt material axially along the breaker members such that the desired aggregate-sized pieces of recyclable asphalt material are delivered through the circumferential spacing between the breaker members.

2. The invention of claim 1 wherein the relatively large pieces of recyclable asphalt material are introduced adjacent an inlet end of the cage-like array and proceed toward an outlet end of the cage-like array, and heat is applied to the breaker members from a source of heat adjacent the outlet end of the cage-like array.

3. The invention of claim 2 including separating pieces of recyclable asphalt material of intermediate size from the desired aggregate-sized pieces of recyclable asphalt material adjacent an outlet end of the cage-like array, and returning the pieces of intermediate size to the inlet end.

4. Apparatus for processing recyclable asphalt material received from the field in relatively large pieces for delivery in a mass containing desired smaller aggregate-sized pieces for reuse, the apparatus comprising:

an elongate drum having a generally cylindrical wall, a central axis, an inlet end and an outlet end;

mounting means for mounting the drum with the central axis tilted at an acute angle so as to elevate the inlet end relative to the outlet end;

a heating chamber adjacent the outlet end of the drum and extending along the drum toward the inlet end over a first axial portion of the drum, the heating chamber having an interior;

a plurality of breaker members connected to the heating chamber for the conduction of heat from the heating chamber to the breaker members, the breaker members being tubular and extending from the heating chamber along a second axial portion of the drum toward the inlet end of the drum, each breaker member having an interior extending along the axial length of the breaker member and each interior being in communication with the interior of the heating chamber, the breaker members being arrayed generally parallel to the central axis of the drum and placed between the central axis and the wall of the drum, the breaker members being spaced from one another circumferentially about the drum to establish a cage-like assembly between the central axis and the wall of the drum, the circumferential spacing between adjacent breaker members being selected such that only the desired smaller aggregate-sized recyclable asphalt material will pass between adjacent breaker members;

heating means for supplying heat to the interior of the heating chamber, such that the heat is conducted to the breaker members connected to the heating chamber;

feed means for feeding the large pieces of recyclable asphalt material received from the field into the cage-like assembly established by the breaker members, adjacent the inlet end of the drum; and rotational means for rotating the drum, and the breaker members therein, about the central axis so as to tumble the large pieces of recyclable asphalt within the heated cage-like assembly, thereby simultaneously reducing the size of the relatively large pieces to the desired aggregate-sized pieces and heating the mass containing the desired aggregate-sized pieces, which mass passes radially between the breaker members to proceed toward the outlet end for delivery at the outlet end of the drum.

5. The invention of claim 4 wherein the tubular breaker members each have a rectangular cross-sectional configuration.

6. The invention of claim 4 including headers between the heating chamber and the breaker members, the circumferential spacing between adjacent headers being greater than the circumferential spacing between the breaker members such that pieces of recyclable asphalt of intermediate size which do not pass radially between the breaker members will proceed axially from the cage-like assembly toward the heating chamber and will pass radially between the headers to exit the drum.

7. The invention of claim 6 wherein the breaker members are tubular, each tubular breaker member having an interior extending along the axial length of the breaker member, and the headers comprise manifolds interconnecting the interior of each breaker member with the interior of the heating chamber.

8. The invention of claim 6 wherein the apparatus includes back feed means for returning the intermediate size pieces to the inlet end of the drum and reinserting the returned intermediate size pieces into the cage-like assembly adjacent the inlet end.

9. The invention of claim 4 wherein the drum wall includes an inner wall portion, an outer wall portion and an annular heat chamber between the inner wall portion and the outer wall portion, and extending axially between the inlet end and the outlet end of the drum, and return members interconnecting the interior of the breaker members with the annular heat chamber adjacent the inlet end of the drum.

10. The invention of claim 4 including scraper means mounted for reciprocating movements axially within the cage-like assembly, the scraper means including scrapers riding on the breaker members for periodic movement along the breaker members to scrape the heated recyclable asphalt from the breaker members.

11. The invention of claim 10 wherein the tubular breaker members each have a rectangular cross-sectional configuration.

12. The invention of claim 4 including auxiliary bars extending generally circumferentially between at least some adjacent breaker members and spaced circumferentially apart to establish said selected spacing through which the aggregate-sized pieces of recyclable asphalt pass.

13. The invention of claim 12 wherein the tubular breaker members each have a rectangular cross-sectional configuration.

14. The invention of claim 4 wherein the heating chamber includes an outer surface extending axially along the heating chamber and spaced radially from the wall of the drum, and flights along the outer surface of the heating chamber for assisting in the movement of the recyclable asphalt to the outlet end of the drum.

15. Apparatus for processing recyclable asphalt material received from the field in relatively large pieces for delivery in a mass containing desired smaller aggregate-sized pieces for reuse, the apparatus comprising:

a plurality of breaker members arranged in a cage-like array circumferentially about a central axis, the breaker members extending axially essentially parallel to the central axis, between an inlet end and an outlet end, the circumferential spacing between adjacent breaker members being such that only the desired aggregate-sized pieces of recyclable asphalt material will pass between adjacent breaker members, the breaker members being tubular, each breaker member having an interior extending along the axial length of the breaker member;

mounting means for mounting the cage-like array with the central axis tilted to elevate the inlet end relative to the outlet end;

heating means associated with the cage-like array adjacent the outlet end such that the cage-like array is heated from the outlet end toward the inlet end, the heating means including an interior, and the interior of each breaker means being in communication with the interior of the heating means;

feed means for feeding the large pieces of recyclable asphalt material received from the field into the cage-like array adjacent the inlet end; and rotating means for rotating the cage-like array and the breaker members thereof about the central axis so as to tumble the large pieces of recyclable asphalt within the heated cage-like array, thereby simultaneously reducing the size of the relatively large pieces to the desired aggregate-sized pieces and heating the mass containing the desired aggregate-sized pieces, which mass passes radially between the breaker members to proceed toward the outlet end for delivery at the outlet end of the cage-like array.

16. The invention of claim 15 wherein the tubular breaker members each have a rectangular cross-sectional configuration.

* * * * *

UNITED STATES PATENT AND TRADEMARK OFFICE

CERTIFICATE OF CORRECTION

PATENT NO. : 5,188,299

DATED : February 23, 1993

INVENTOR(S) : Arthur N. Hendrickson, Lawrence C. Hanlon and Russell W. Anderson

It is certified that error appears in the above-identified patent and that said Letters Patent is hereby corrected as shown below:

Column 7, lines 48 through 51, delete "the breaker members ... breaker member, and"

Signed and Sealed this

Fifth Day of April, 1994

Bruce Lehman

*Attest:*

BRUCE LEHMAN

*Attesting Officer*

*Commissioner of Patents and Trademarks*